US007344630B2

(12) United States Patent
Tu et al.

(10) Patent No.: US 7,344,630 B2
(45) Date of Patent: Mar. 18, 2008

(54) METHOD AND APPARATUS FOR ELECTROPLATING SMALL WORKPIECES

(76) Inventors: Hsiue-Te Tu, 23F-3, No. 29, Ching-Nien 1st Td., Ling-Ya Dist., Kaohsiung City (TW); Wayne Tu, 135, Schnapper Rock Road, Albany, Auckland 1311 (NZ)

( * ) Notice: Subject to any disclaimer, the term of this patent is extended or adjusted under 35 U.S.C. 154(b) by 157 days.

(21) Appl. No.: 11/402,569

(22) Filed: Apr. 12, 2006

(65) Prior Publication Data

US 2007/0240994 A1 Oct. 18, 2007

(51) Int. Cl.
*C25D 5/00* (2006.01)
*C25B 9/00* (2006.01)

(52) U.S. Cl. ..... 205/143; 204/242

(58) Field of Classification Search ..... 205/143; 206/664; 99/636, 635; 361/672; 171/111; 209/672

See application file for complete search history.

(56) References Cited

U.S. PATENT DOCUMENTS 1,912,400 A * 6/1933 O'Neill ..... 204/201
6,322,685 B1 * 11/2001 Kang et al. ..... 205/143

* cited by examiner

*Primary Examiner*—Barbara L. Gilliam
*Assistant Examiner*—Dustin Q Dam
(74) *Attorney, Agent, or Firm*—Ostrolenk, Faber, Gerb & Soffen, LLP

(57) ABSTRACT

A method for electroplating small workpieces includes the steps of: (A) providing a rotatable barrel which has an axis of rotation and a plurality of spaced-apart partition plates disposed one above the other; (B) mounting the barrel in a plating tank with the axis of rotation being inclined with respect to a horizontal line; (C) feeding a batch of the workpieces into the barrel; and (D) allowing the workpieces to fall down by gravity from one of the partition plates to the other one of the partition plates by rotating the barrel.

7 Claims, 5 Drawing Sheets

METHOD AND APPARATUS FOR ELECTROPLATING SMALL WORKPIECES

BACKGROUND OF THE INVENTION

1. Field of the Invention

The invention relates to a method and an apparatus for electroplating small workpieces.

2. Description of the Related Art

Referring to FIG. 1, a conventional barrel 1 used in an electroplating process is immersed in a plating solution 22 of a plating tank 21. The barrel 1 is formed with a plurality of perforations 14 to permit flowing of the plating solution 22 there through, and includes a conductive piece 13 at the center of the barrel 1, a top opening 15, and a cover plate 16 to openably close the top opening 15. Two transmission gears 12 (only one is shown) are respectively provided on two opposite sides of the barrel 1.

During electroplating, small workpieces 3, such as screws, are put into the barrel 1 via the opening 15, after which the opening 15 is closed by the cover plate 16. The barrel 1 is then immersed in the plating solution 22 of the plating tank 21. The transmission gears 12 are subsequently activated so as to rotate the barrel 1 about a horizontal axis, thereby plating the workpieces 3.

However, loading and unloading of the workpieces 3 from the barrel 1 are time-consuming. In particular, the barrel 1 must be removed from the plating tank 21 and uncovered to unload the electroplated workpieces 3. After unloading, the barrel 1 is loaded with a new batch of workpieces 3 and is then re-immersed in the plating tank 21 to proceed with electroplating. Hence, the efficiency of the aforementioned conventional electroplating process is not high.

FIG. 2 shows another conventional barrel 4 that extends in a plating solution 22 (shown in phantom lines) Through a driving unit 23, the barrel 4 can be activated to rotate along a horizontal axis. The barrel 4 includes a helical partition plate 44 extending along an inner wall face of the barrel 4.

After the workpieces 3 are put into the barrel 4, the barrel 4 is rotated by the driving unit 23, such that the workpieces 3 move forwardly along the lower side of the inner wall face of the barrel 4 and are immersed in the plating solution 22. The electroplating process continues until the electroplated workpieces 3 are moved out of the barrel 4. Although the workpieces 3 can be loaded into or unloaded from the barrel 4 without the need to stop rotation of the barrel 4, since the workpieces 3 are moved along the inner wall face of the barrel 4 through the helical partition plate 44, the tumbling movement of the workpieces 3 is limited so that the platings formed on the workpieces 3 are thin and not uniform.

SUMMARY OF THE INVENTION

Therefore, the object of the present invention is to provide a method and an apparatus for electroplating small workpieces that are capable of overcoming the aforementioned prior art drawbacks.

According to one aspect of this invention, a method for electroplating small workpieces comprises the steps of: (A) providing a rotatable barrel which has an axis of rotation and a plurality of spaced-apart partition plates disposed one above the other; (B) mounting the barrel in a plating tank with the axis of rotation being inclined with respect to a horizontal line; (C) feeding a batch of the workpieces into the barrel; and (D) allowing the workpieces to fall down by gravity from one of the partition plates to the other one of the partition plates by rotating the barrel.

According to another aspect of this invention, an apparatus for electroplating small workpieces comprises a plating tank, a barrel, and a barrel support. The barrel includes a surrounding wall, a top wall with a top inlet opening, a bottom wall with a bottom outlet opening, and a plurality of spaced-apart partition plates disposed one above the other between the top and bottom walls and spanning the surrounding wall. Each of the partition plates has a passage hole proximate to an inner side of the surrounding wall. The passage hole in each of the partition plates is staggered with the passage hole in an immediately adjacent one of the partition plates. The barrel support holds the barrel in the plating tank in an inclined position so that the partition plates are inclined with respect to a horizontal line.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
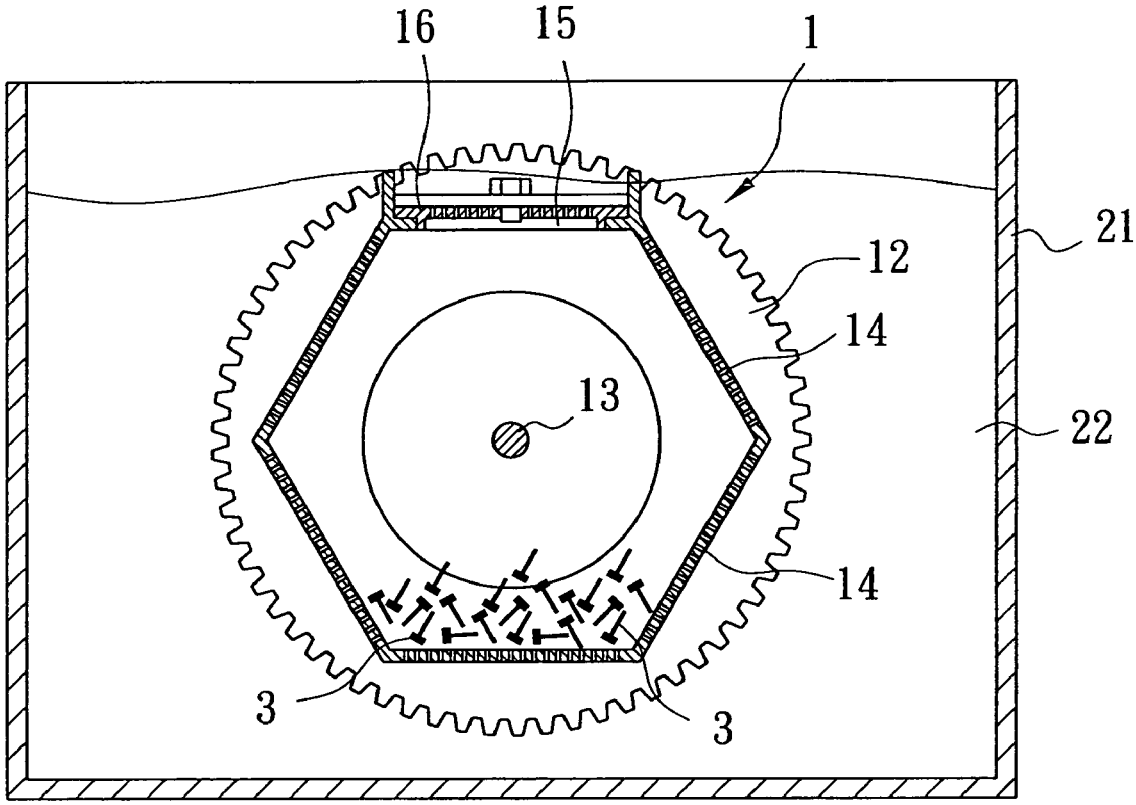
FIG. 1 PRIOR ART
FIG. 1 is a sectional view of a conventional barrel immersed in a plating solution of a plating tank.
Figure 2:
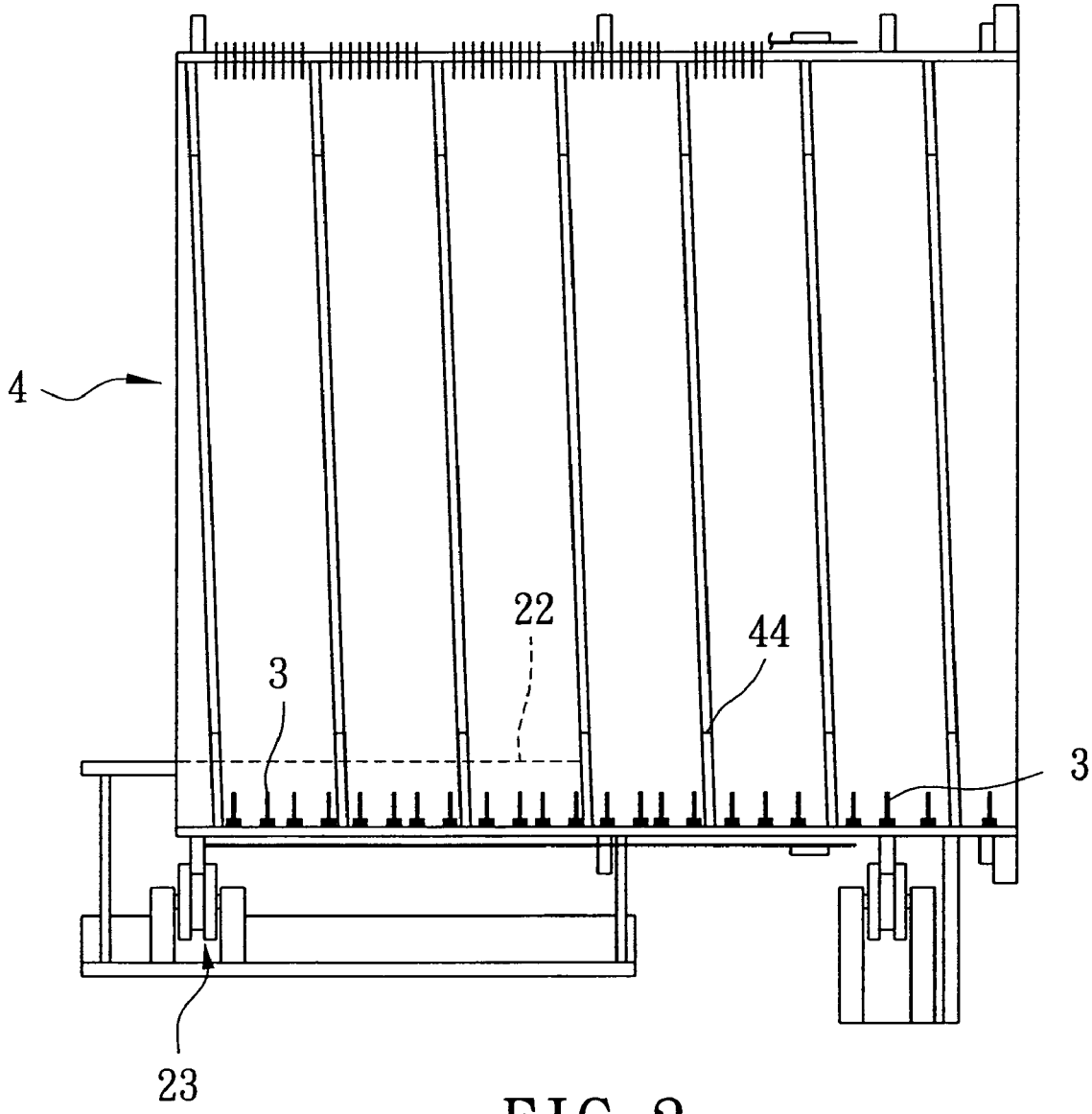
FIG. 2 PRIOR ART
FIG. 2 is a schematic side view of another conventional barrel.

Referring to FIGS. 3 to 6, the preferred embodiment of an apparatus 5 for electroplating small workpieces 7 according to the present invention is shown to comprise a barrel support 51, a plating tank 52 containing a plating solution 50, a barrel 53, a drive unit 54, and a conveying unit 55.

The barrel support 51 is provided in the plating tank 52 to support the barrel 53, and includes a lower inclined support member 511 disposed inside the plating tank 52, and an upper inclined support member 512 disposed above the lower inclined support member 511. However, the present invention need not be limited to the construction of the barrel support 51 shown in FIG. 3 and may employ any other suitable support that can rotatably and inclinedly hold the barrel 53 in the plating tank 52.

The barrel 53 has an axis of rotation (L), and includes a surrounding wall 531 having a plurality of perforations 536 to permit flowing of the plating solution 50 therethrough, top and bottom walls 532, 533 connected respectively to top and bottom ends of the surrounding wall 531, a top inlet opening 534 formed in the top wall 532, a bottom outlet opening 535 formed in the bottom wall 533, and three spaced-apart partition plates 537 disposed one above the other between the top and bottom walls 532, 533 and spanning the surrounding wall 531. The barrel 53 is supported in the plating tank 52 with the axis of rotation (L) being inclined with respect to a horizontal line by the barrel support 51 so that the partition plates 537 are also inclined with respect to the horizontal line. The top wall 532 is supported rotatably by the upper inclined support member 512, while the bottom wall 533 is supported rotatably by the lower inclined support member 511.

The partition plates 537 cooperate with the surrounding wall 531 and the top and bottom walls 532, 533 to define first, second, third, and fourth receiving spaces (530*a*, 530*b*, 530*c*, 530*d*). The first receiving space (530*a*) is in spatial communication with the top inlet opening 534. The fourth receiving space (530*d*) is in spatial communication with the bottom outlet opening 535. Each partition plate 537 has a passage hole 539 proximate to an inner side of the surrounding wall 531. The passage hole 539 in each partition plate 537 is staggered in an axial direction with the passage hole 539 in an immediately adjacent one of the partition plates 537. Preferably, the passage hole 539 in each partition plate 537 is diametrically opposite to the passage hole 539 in the immediately adjacent one of the partition plates 537. The top inlet opening 534 is staggered with the passage hole 539 in an uppermost one of the partition plates 537, and the bottom outlet opening 535 is staggered with the passage hole 539 in a lowermost one of the partition plates 537.

Figure 4:
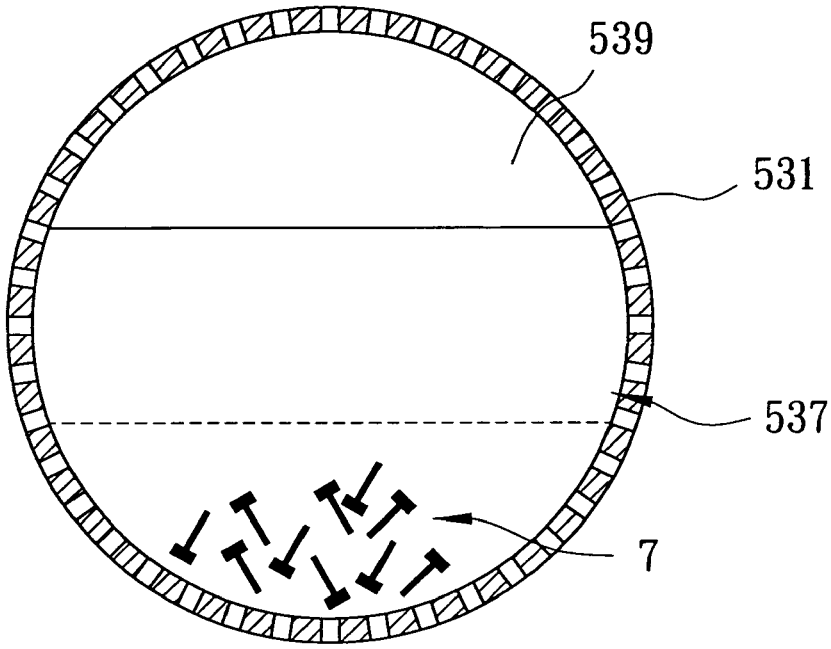
FIG. 4 is a sectional side view taken along line IV-IV of FIG. 3, illustrating one configuration of a passage hole of a partition plate.
Figure 5:
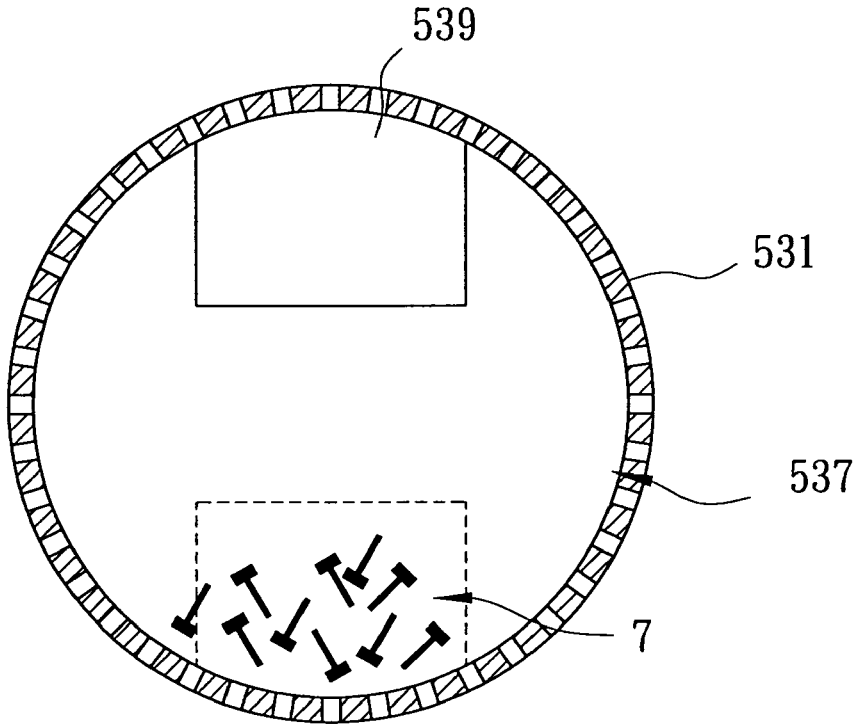
FIG. 5 is a view similar to FIG. 5, but illustrating another configuration of the passage hole of the partition plate.

The passage hole 539 in each partition plate 537 may be sector-shaped, as shown in FIG. 4, or rectangular, as shown in FIG. 5. The size and shape of the passage holes 539 are not limited. As long as the size of each passage hole 539 is not too large to reduce significantly the retention time of the workpieces 7 in each receiving space (530*a*, 530*b*, 530*c*, 530*d*) and to decrease the effect of plating the workpieces 7, any size and shape of the passage hole 539 may be suitably used. Preferably, the size of each passage hole 539 is smaller than one-half the area of the corresponding partition plate 537.

The drive unit 54 is mounted on the upper inclined support member 512 to rotate the barrel 53 about an axis (L).

The conveying unit 55 includes a conveying belt 551 disposed proximate to the bottom outlet opening 535 to receive the plated workpieces 7 that fall out from the barrel 53 by virtue of gravity. The conveying unit 55 may be any conventional conveyor that can convey the workpieces 7 falling from the barrel 53.

Figure 3:
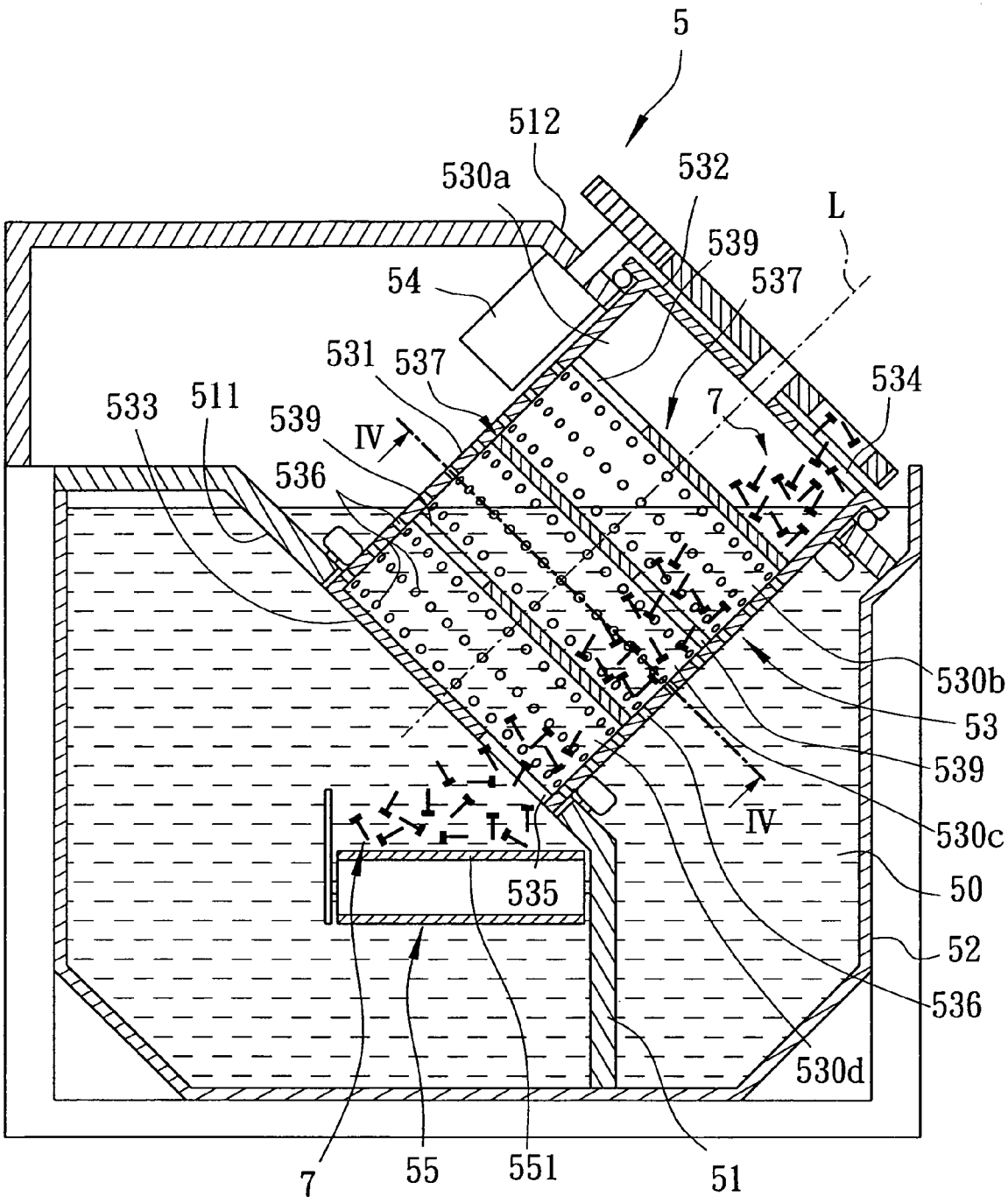
FIG. 3 is a sectional side view of the preferred embodiment of an apparatus for electroplating small workpieces according to the present invention.
Figure 6:
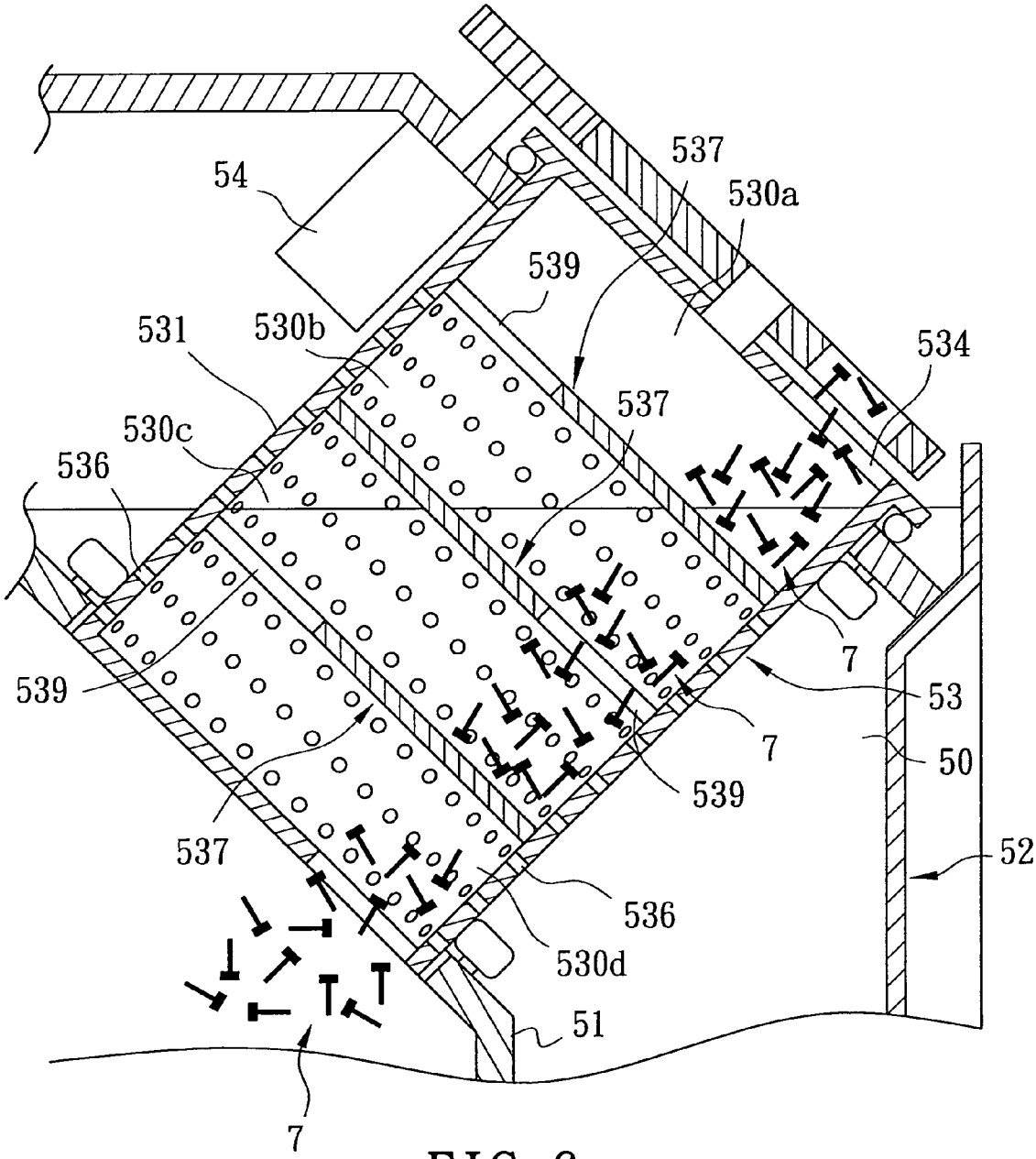
FIG. 6 is an enlarged fragmentary sectional view of the preferred embodiment.

A method for electroplating the small workpieces 7 using the apparatus 5 will now be described with reference to FIGS. 3 and 6.

The barrel 53 is first placed in the plating tank 52 with the axis of rotation (L) being inclined with respect to the horizontal line by mounting the barrel 53 on the barrel support 51 so that the partition plates 537 are also inclined with respect to the horizontal line. The plating solution 50 may be varied as needed. For example, to electroplate screws, a chrome solution is generally used to form a chromium metal film layer on each screw.

Next, the barrel 53 is rotated at a predetermined speed about the axis of rotation (L) so that each partition plate 537 rotates to move the corresponding passage hole 539 upward and downward alternately between topmost and bottommost positions. Each partition plate 537 retains the workpieces 7 when the corresponding passage hole 539 is at the topmost position, and delivers the workpieces 7 to a lower one of the receiving spaces (530*a*, 530*b*, 530*c*, 530*d*) when the corresponding passage hole 539 is at the bottommost position.

A batch of the workpieces 7 is fed into the first receiving space (530*a*) via the top inlet opening 534. Hence, the workpieces 7 are retained on the uppermost one of the partition plates 537 which has its passage hole 539 moved to the topmost position. As the barrel 53 continues to rotate, the workpieces 7 fall downward into the second receiving space (530*b*) and onto the adjacent partition plate 537 by virtue of gravity. This is made possible by the passage hole 539 in the uppermost one of the partition plates 537 being moved to the bottommost position and the passage hole 539 in the immediately adjacent partition plate 537 being moved to the topmost position.

A new batch of the workpieces 7 is fed into the first receiving space (530*a*) via the top inlet opening 534 after the previous batch of the workpieces 7 has fallen from the uppermost one of the partition plates 537 to the partition plate 537 immediately therebelow. Generally, whenever the barrel 53 completes one cycle of rotation, a new batch of the workpieces 7 can be fed into the barrel 53. Hence, continuous feeding of the workpieces 7 can be performed with the apparatus 5. There is no need to stop rotation of the barrel 53 when the workpieces 7 are loaded into the barrel 53 so that electroplating can be conducted in a highly productive manner.

Continued rotation of the barrel 53 causes the workpieces 7 to fall downward from the partition plates 537 one after the other and eventually from the bottom wall 533 to the conveying unit 55.

Through the continuous rotation of the barrel 53, the passage hole 539 in each partition plate 537 can move alternately at a fixed speed between the topmost and bottommost positions. Therefore, each batch of the workpieces 7 can be retained in each receiving space (530*a*, 530*b*, 530*c*, 530*d*) for a period of time to permit the workpieces 7 to thoroughly make contact with the plating solution 50. As a result, the workpieces 7 can be plated gradually and uniformly layer by layer. To ensure that surfaces of the workpieces 7 are completely plated and to increase the plating thickness of the metal film layers, the time the workpieces 7 stay in each receiving space (530*a*, 530*b*, 530*c*, 530*d*) can be extended. In the present invention, additional partition plates 537 may be provided to increase the number of the receiving spaces (530*a*, 530*b*, 530*c*, 530*d*) in the barrel 53. As such, each batch of the workpieces 7 may undergo plating for a prolonged time to achieve better surface-covering and plating thickness results. If a thick metal film layer is not desired, on the other hand, the number of the partition plates 537 can be reduced so as to shorten the plating time.

The description below will permit further understanding of the operation of the present invention. If it is assumed that the rotational speed of the barrel 53 is one cycle per minute, and that there are three partition plates 537 in the barrel 53 defining four receiving spaces (530*a*, 530*b*, 530*c*, 530*d*), for each batch of the workpieces 7 fed into the barrel 53, the total time required to pass through the four receiving spaces (530*a*, 530*b*, 530*c*, 530*d*) and the bottom outlet opening 535 is 4 minutes. Because subsequent batches of the workpieces 7 can be fed respectively for each turn of the barrel 53, when one batch of the workpieces 7 is moved out of the barrel 53, the barrel 53 still has four batches of the workpieces 7 therein, so that in the next 4 minutes, four batches of the workpieces 7 can fall consecutively out of the bottom outlet opening 535. It is apparent, then, that following the initial 4 minutes, electroplating may be performed at a steady rate and in a highly productive manner.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A method for electroplating small workpieces, comprising:

(A) providing a rotatable barrel which has an axis of rotation and a plurality of spaced-apart partition plates disposed one above the other;

(B) mounting the barrel in a plating tank with the axis of rotation being inclined with respect to a horizontal line;

(C) feeding a batch of the workpieces into the barrel; and (D) allowing the workpieces to fall down by gravity from one of the partition plates to the other one of the partition plates by rotating the barrel.

2. The method as claimed in claim 1, further comprising the step of feeding an additional batch of the workpieces into the barrel after a previous batch of the workpieces has fallen down from a topmost one of the partition plates.

3. The method as claimed in claim 1, further comprising the step of delivering the workpieces into a conveying unit provided below the barrel.

4. The method as claimed in claim 1, further comprising:

providing a passage hole in each of the partition plates;

allowing the passage hole to move upward and downward alternately during rotation of the barrel; and retaining the workpieces in each of the partition plates when the corresponding passage hole moves upwardly, and allowing the workpieces to fall down from each of the partition plates through the corresponding passage hole when the corresponding passage hole moves downwardly during rotation of the barrel.

5. An apparatus for electroplating small workpieces, comprising:

a plating tank;

a barrel including a surrounding wall, a top wall with a top inlet opening, a bottom wall with a bottom outlet opening, and a plurality of spaced-apart partition plates disposed one above the other between said top and bottom walls and spanning said surrounding wall, each of said partition plates having a passage hole proximate to an inner side of said surrounding wall, said passage hole in each of said partition plates being staggered with said passage hole in an immediately adjacent one of said partition plates; and a barrel support holding said barrel in said plating tank in an inclined position so that said partition plates are inclined with respect to a horizontal line.

6. The apparatus of claim 5, wherein said barrel support includes a lower inclined support member disposed inside said plating tank and supporting said bottom wall, and an upper support member disposed above said lower inclined support member and supporting said top wall.

7. The apparatus of claim 6, further comprising a drive unit to rotate said barrel, and a conveying unit disposed proximate to said bottom outlet opening.

* * * * *